US006044680A

United States Patent [19]

Pegoraro

[11] Patent Number: 6,044,680

[45] Date of Patent: Apr. 4, 2000

[54] MACHINING OF SHEET WITHOUT REMOVAL OF MATERIAL

[75] Inventor: Giancarlo Pegoraro, St.-Legier, Switzerland

[73] Assignee: Conception et Developpement Michelin, Givisiez, Switzerland

[21] Appl. No.: 09/189,450

[22] Filed: Nov. 10, 1998

[30] Foreign Application Priority Data

Nov. 13, 1997 [FR] France ..... 97 14345

[51] Int. Cl.[7] ..... B21D 3/14; B21K 5/20

[52] U.S. Cl. ..... 72/183; 72/311; 72/379.2; 72/378; 76/107.1

[58] Field of Search ..... 72/183, 177, 307, 72/311, 378, 379.2, 285, 291; 76/107.1, 101.1

[56] References Cited

U.S. PATENT DOCUMENTS

| | | | |
|---|---|---|---|
| 2,148,469 | 2/1939 | Hudson | 72/378 |
| 2,224,337 | 12/1940 | Bostwick | 76/107.1 |
| 2,935,114 | 5/1960 | Anderson | 72/183 |
| 3,495,427 | 2/1970 | Balamuth | 72/285 |
| 3,514,989 | 6/1970 | Robinson . | |
| 3,768,296 | 10/1973 | Pollak | 72/377 |
| 4,528,836 | 7/1985 | Durand-Texte | 72/377 |
| 5,086,635 | 2/1992 | Creaser | 72/307 |
| 5,156,036 | 10/1992 | Michaels | 72/285 |
| 5,327,767 | 7/1994 | Narishima | 72/338 |
| 5,492,669 | 2/1996 | Laurent et al. . | |

FOREIGN PATENT DOCUMENTS

| | | | |
|---|---|---|---|
| 718044 | 1/1932 | France . | |
| 991116 | 10/1951 | France . | |
| 1217035 | 4/1960 | France . | |
| 52568 | 6/1942 | Netherlands | 72/183 |
| 1480164 | 7/1977 | United Kingdom . | |

*Primary Examiner*—Daniel C. Crane
*Attorney, Agent, or Firm*—Baker Botts L.L.P.

[57] ABSTRACT

A method and device for machining a sheet contains a jaw equipped with two plates mounted opposite each other in order to delimit a calibration opening between said plates in which it is possible to vary the spacing between plates. A clamp is provided for grasping the sheet, and the clamp is moved in relation to said plates. The movement of the clamp and the relative position of said plates is coordinated, so as to slide the sheet in relation to said plates while the distance between said plates is controlled. The process includes pulling the sheet by one end so as to separate an initial section from the plane containing the calibration opening and thus pass the sheet through the calibration opening while the plates are kept supported against said sheet, so as to vary continuously the thickness of the sheet while the sheet is passed through the calibration opening.

9 Claims, 3 Drawing Sheets

MACHINING OF SHEET WITHOUT REMOVAL OF MATERIAL

BACKGROUND OF THE INVENTION

The present invention concerns the machining of sheets, or even of plates (comparable to sheets in the context of this invention), with a view to obtaining nonparallel faces on said sheets.

In metallurgy, rough sheets are usually obtained by rolling. A rolling operation results in a difference in rate of advance of the sheet between upstream and downstream in the rolling operation, which is manifested by an increase in length of the sheet after rolling. Fundamentally, in an operation as described above, the dimensions of the sheet are changed, while keeping a rectangular profile (section perpendicular to the direction of movement). The product obtained comes with generally parallel faces, with a certain level of tolerance for the flatness of each of the faces and for the thickness between faces. If it is desired to hold the flatness and/or thickness within close tolerances, the sheets generally have to be rectified.

Furthermore, starting with a standard sheet, it is difficult to obtain profiles with nonparallel faces by rolling. If, for example, the respective axes of the rollers are not parallel, the volume of material treated per unit of width (dimension parallel to the axis of the rollers) is no longer constant. As a result, the rate of advance tends to be greater in the places rolled to lesser thickness. That produces very sizable internal stresses in the rolled sheet and, therefore, very great difficulty in obtaining a rolled product without curvature. There again, the sheets often have to be straightened to obtain the desired profile.

SUMMARY OF THE INVENTION

The objective of the present invention is to produce sheets whose faces are not parallel. A particular case consists in obtaining nonparallel, plane faces. By convention, in the latter case, "sloped" sheets are hereafter referred to as sheets whose faces form inclined planes in relation to each other, ranging from very small to larger angles. According to one particular aspect of this invention, a so-called "sloped" blank is made, in which it is then possible, by any technique, to cut an object to the contour predefined as a function of the final application sought.

The invention proposes a process of machining a sheet without removal of material, comprising:

- nipping said sheet between two appreciably longitudinal tool bearings engaging the sheet and defining a section of the latter, said bearings delimiting between them a calibration opening, whose large dimension is greater than the width of the sheet to be machined and whose small dimension determines the thickness of the sheet along said section,
- grasping said sheet at one end, over the whole width of said sheet, adjacent the calibration opening,
- pulling the sheet by said end so as to separate an initial section of the plane containing the calibration opening and thus pass the sheet through the calibration opening, while said longitudinal bearings are kept supported against said sheet, so as to control said thickness according to a predetermined relationship as a function of the distance of separation of the initial section, said predetermined relationship being such that the thickness of the sheet is caused to be continuously changed while the sheet passes through the calibration opening.

The invention can be applied whenever an end product or a semifinished product is a sheet whose section is trapezoidal, that is, having opposite sloped faces. It is possible to cite, by way of nonlimitative example, the manufacture of knife blades or the manufacture of a certain type of tire tread mold, the basic idea of which is disclosed in U.S. Pat. No. 5,492,669.

The invention will be more fully understood by reference to the following specification, illustrating with the drawings, in nonlimitative fashion, a working example of the invention, as well as one particular use of same.

DESCRIPTION OF PREFERRED EMBODIMENTS

Figures 1, 2:
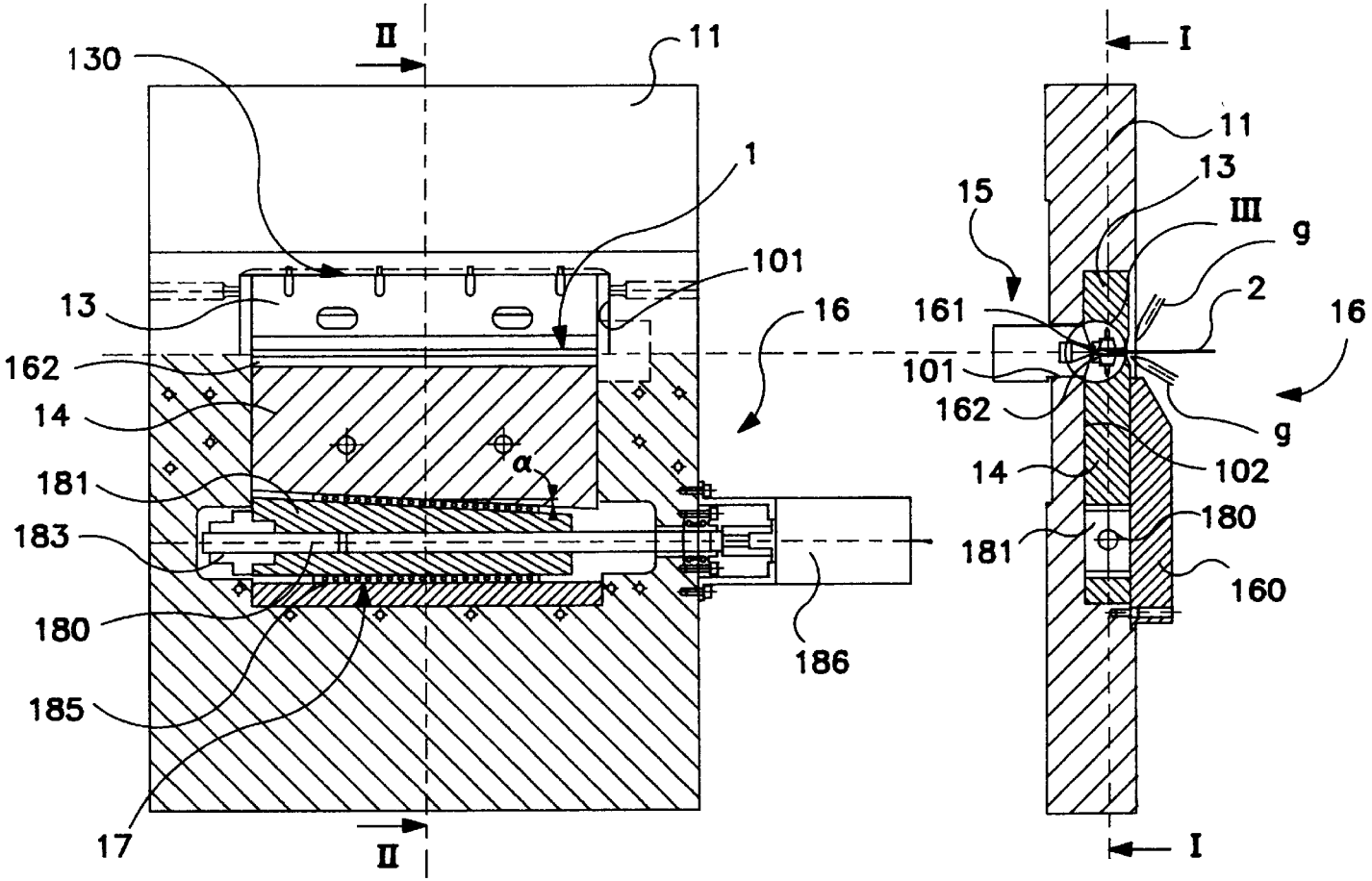
FIG. 1 is a section of a machining device according to the invention, along I—I of FIG. 2.
FIG. 2 is a half-view and half-section of a machining device according to the invention, along II—II FIG. 1.

The machining device represented in FIGS. 1 to 4 includes a frame 11 supporting a jaw 16 holding two plates 161 and 162 mounted opposite each other in order to delimit between said plates 161, 162 a calibration opening 1. The device contains means for forcing the sheet to move in respect to and in relation to the calibration opening: a clamp 15 that can grasp the sheet 2, which clamp can be moved in relation to said plates 161 and 162. The jaw 16 closes on the sheet 2 and draws the sheet 2. In its movement of separation from the plates 161 and 162, the clamp will not be too distant from a plane perpendicular to the plane of the calibration opening 1, passing through said opening.

In other words, the sheet is passed through a calibration opening, creating a sort of die, not for drawing a wire, but for machining a sheet. However, the invention differs radically from the analogy to wiredrawing by the shape of the opening formed, which creates a new dimension for addressing sheets.

Said means for forcing the sheet to move with respect to and in relation to the calibration opening is such that the space between the two plates 161 and 162 is caused to be continuously changed along with the advance of the clamp 15 in order that the thickness of the sheet is continuously changed while the sheet passes through the calibration opening.

Figure 5:
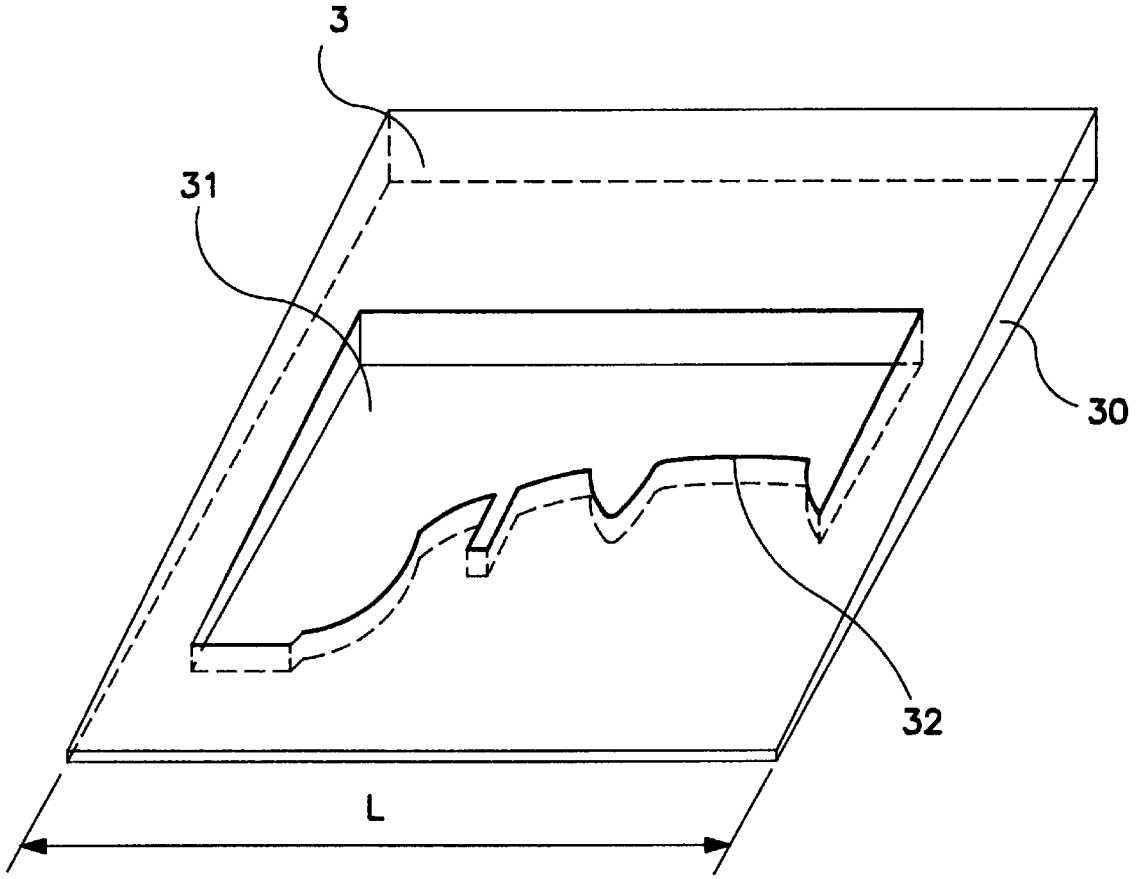
FIG. 5 illustrates the application to manufacture of a tire mold.

In the particular application referred to and illustrated by means of FIG. 5, the relationship is such that the thickness increases linearly with the distance of separation. More precisely, the thickness diminishes when the distance of separation increases. It is evident that, from this aspect, the invention differs also from the technical analogy constituted by wiredrawing by virtue of the variable character of the calibration opening. In its form for more universal use, the machining device contains means for coordinating the movement of said clamp and the relative position of said plates, so as to slide the sheet in relation to said plates while the distance between said plates is varied according to a relationship depending on the final shape to be obtained. Clearly, said relationship can be easily adjusted on an experimental basis taking into account the differences between the desired shape and the actual shape obtained with the first trials.

Turning now to a description of the means for varying the spacing between the plates 161 and 162, the frame 11 has a window 101 opening in the center, extended on one side by a clearance 102 (see FIG. 2), receiving said jaw 16. One of the plates 161 is mounted on a stationary plate holder 13, and the other 162 is mounted on a movable plate holder 14 by means of trapezoidal keys 131 and 141 respectively (see, in particular, FIG. 3). The back 130 of the stationary plate holder 13 is a circular-base cylinder, the axis of said cylinder being perpendicular to the plane of FIG. 1. The purpose of that structural arrangement is to be able to adjust the parallelism of the plates 161 and 162 by transversely displacing the stationary plate holder 13 in relation to the frame 11. Considering the range of adjustment sought, the radius of the arc forming the face of that cylinder in the plane of FIG. 1 is so great that the curvature is not discernable on FIG. 1.

A wedge 181 is inserted between the moving plate holder 14 and a reference surface 17 on the frame 11, with interposition of needle bearing paths 185. That wedge 181 is mounted on a nut 183, which in turn is mounted on a screw 180. The translation of the screw 180 along its axis is blocked by a suitable arrangement. The translation of the movable plate holder 14 is carried out while it still remains parallel to itself, and the stresses that the moving plate holder 14 exerts in the direction parallel to the axis of the screw 180 are taken up by the frame 11. The moving plate holder 14 and the set of components cooperating with it are kept in place against the frame 11 by a plate 160.

The wedge 181 forms an angle $\alpha$ whose value is chosen to develop on the sheet a stress sufficient to deform it, while insuring that the length of displacement of the wedge is sufficient to control with great precision the relative movement of the plates. The screw 180 is driven by a motor 186. The rotation of the screw 180 in one direction makes it possible to move the wedge 181 in one direction (for example, from left to right in FIG. 1); the rotation of the shaft 180 in the other direction makes it possible to move the wedge 181 in the other direction. Taking into account the direction of mounting of the wedge 181, a displacement of the wedge 181 from left to right in FIG. 1 increases the space between the movable plate holder 14 and the reference surface 17 and therefore reduces the distance between the moving plate holder 14 and the stationary plate holder 13 which, in turn, reduces the distance between the plates 161 and 162. The equilibrium of stresses involved passes through the frame 11, dimensioned accordingly. Return springs (not shown) guarantee that the stationary plate holder 13 and movable plate holder 14 are separated from each other when the wedge 181 is moved from right to left in FIG. 1.

Figure 4:
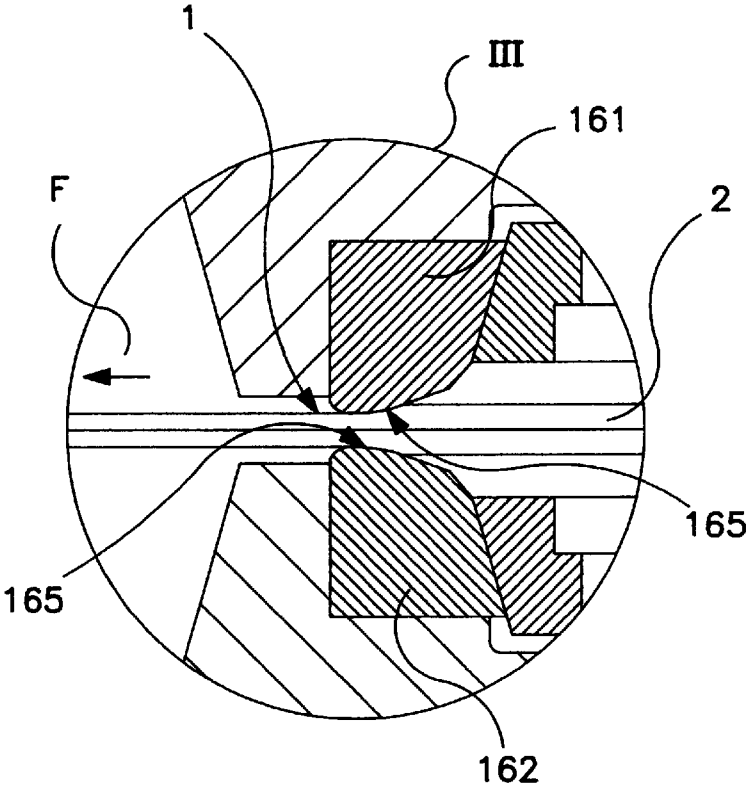
FIG. 4 is a view comparable to that of FIG. 3, showing the sheet in a subsequent phase of machining.
Figure 3:
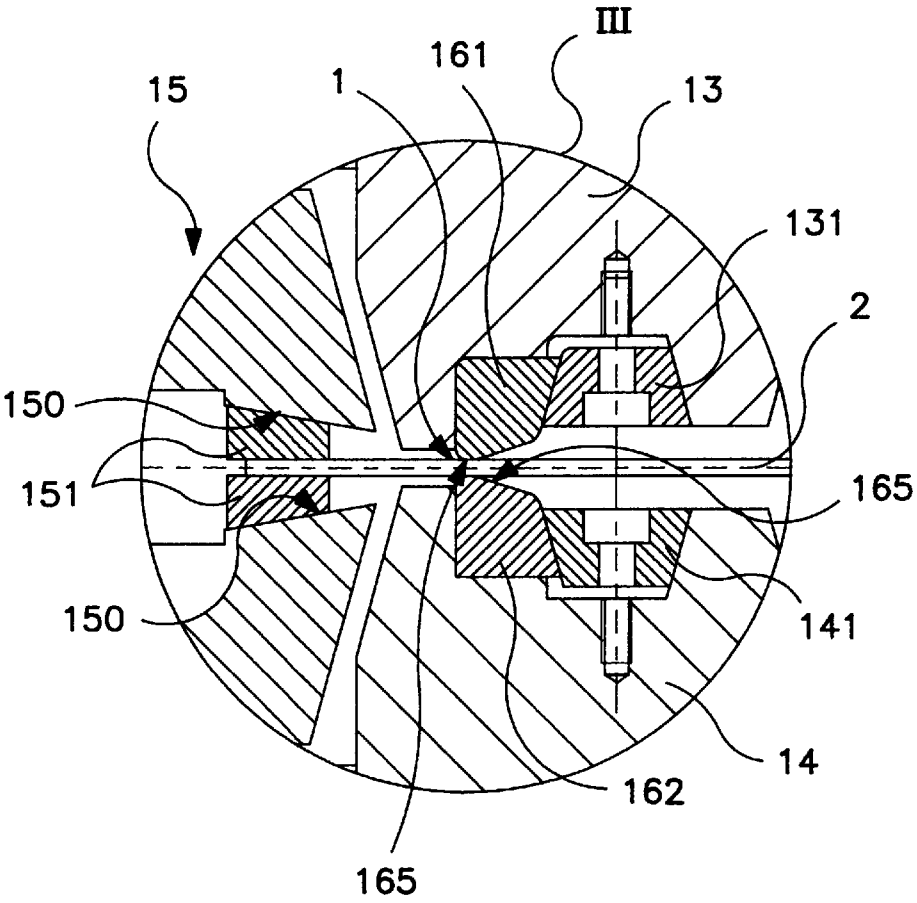
FIG. 3 is ansehlargement of the part delimited by circle III on FIG. 1.

The section of each of the plates 161 and 162 in the functional zone, that is, the zone of bearings 165, has a rounded shape in order to define, with the opposite plate and taking into account the direction of advance of the sheet 2 through the jaw 16, convergent bearings forming a progressive striction (see FIGS. 3 and 4). Viewed in the other direction (i.e., in the plane of FIG. 1), the shape of the plates 161 and 162 is in this example linear. More generally, if it appears that the actual shape of the sheet is not the desired shape, the difference can be corrected by modifying the actual shape of the plates to obtain what is desired after machining the sheet. An appropriate surface treatment makes it possible to give said bearings 165 a suitable hardness. For example, tungsten carbide plates having undergone titanium nitride and molybdenum disulfide-base surface treatment, combined with lubrication, present a suitable resistance and sliding surface (coefficient of friction).

Hoses 9 make it possible to project a lubricant, a machine oil, for example, to coat the faces of the sheet just before the calibration opening. A strong chlorine additive oil can be used, for example.

A clamp 15, with self-tightening jaw, is placed parallel to jaw 16. This clamp contains trapezoidal tightening blocks 151 inserted between the object to be clamped, in this case the sheet 2, and support surfaces 150 inclined to converge beside the jaw 16. The clamp 15 makes it possible to grip the sheet 2 firmly at one of its ends. The clamp must, of course, be capable of closing to grasp the sheet 2 properly and of opening to release the sheet 2. The necessary structural details will be easily designed by the expert and do not appear on the drawing in order not to overload it needlessly. A traction gear (not represented) makes it possible to separate the clamp 15 from the jaw 16 (or bring them nearer in order to make the sheet move back between two passes), clamp and jaw remaining constantly parallel, the clamp moving in a plane perpendicular to the plane in which the movement of the plates 161 and 162 of the jaw 16 is developed. As a variant, a hydraulic tightening clamp can be used.

In order to machine the sheet, the size of the opening between plates 161 and 162, which at the outset corresponds roughly to the thickness of the sheet 2 (see FIG. 3) is gradually reduced (see FIG. 4, in which arrow F shows the direction of advance of the sheet) to the minimum thickness desired, while the sheet 2 is transversely displaced by separating the clamp 15 from the jaw 16 (displacement from right to left in FIGS. 1, 3 and 4). The relationship is such that the thickness diminishes when the separation increases. The movement of the wedge 181 and the separation of the clamp 15 are, of course, coordinated in order to obtain the desired profile on the sheet 2.

It has been observed that, as with many other machining techniques, the best results are obtained if, in the course of a pass, the rate of deformation of the sheet does not exceed certain limits. That depends on the nature of the material. It is also necessary to take into account the sloped angle and the length machined. In fact, taking into account the fact that the total volume of materials is maintained, the parameter to be taken into account is the quantity of material displaced by machining. The more there is, the greater the number of passes required. Thus, for example, for a ductile stainless steel, if a sloped angle reaching a magnitude of 0.1° is desired, for a machined length in the order of 10 centimeters, it is preferable to work the sheets in at least two successive passes. Thus, on each pass, a law aiming at different thicknesses is used. Machining in several passes allows the accuracy of the dimensions and/or the surface texture to be improved.

The invention makes it possible to machine without supply of heat. The invention also makes it possible to machine by having constant rates of deformation along the section worked. The resulting advantage is the absence or at least very slight impact of undesired deformations and, therefore, little or no buckling of the sheet after machining.

The proposed machining process easily fits into a more complex installation fabricating blanks for a particular application. For example, one starts with a continuous metal strip, the width and thickness of which are chosen according to the width and maximum thickness of the blank to be fabricated.

The strip, packaged, for example, in coil form, feeds a machining device, as described. Even if the strip had an initial curvature owing to its coil storage, the drawing due to the process automatically eliminates any curvature, which renders any subsequent straightening unnecessary. If several passes are required, the strip moves back into the machining device between two passes. In a variation, each pass can be made on different successive devices. In the course of successive passes, the faces of the sheet remain flat, their relative inclination increasing. At the end of the last pass, the strip is sectioned by closing the jaw 16 ahead without longitudinal displacement of the strip in relation to the clamp 15, in order to mark a zone of sectioning of said strip, and without relaxing the tightening imposed by the plates 161 and 162, a blank is individualized by the pull on said strip by the clamp 15 until rupture.

Machining by deformation, as proposed, makes possible a great saving of material, compared to machining by removal of material. The type of material depends on the application sought, the process being suitable for all sufficiently ductile materials. A particularly important application of the invention lies in machining steel sheets between 0.5 millimeter and 3 millimeters thick.

As mentioned above, the invention is advantageously applicable to the manufacture of a type of tire tread mold. Referring to the specification of a tire mold given in U.S. Pat. No. 5,492,669, it is observed that said mold is formed by circumferential stacking of a large number of elements, the section of which, seen in a plane perpendicular to the axis of the mold, is preferably trapezoidal. The invention proposes a process which makes it possible to obtain a blank suitable for cutting said elements. Said elements are then cut to the desired profile so that, on the narrower side, a part of the section will be in a molding zone of a corresponding section of the tread, and so that outside said molding zone the section complementing the aforementioned part will cooperate with devices controlling the mold opening and closing movements.

The steel thus machined is a stainless steel, by reason of use of the blanks in a tire mold. With a continuous strip, blanks are mass-produced by applying the process described above and then production is coordinated by progressively cutting one or more of the elements in each blank, according to the profile desired, and progressively stacking said elements to form said mold.

More precisely, the dimensions of the blank 3 are determined from the mathematical definition of the tread surface, as the tire designer has conceived it, and from choice of the number of elements to be contained in the crown ensuring the molding of said tread. FIG. 5 shows that it is a trapezoid, seen in section perpendicular to the axis of rotation of the tire (see face 30), the width L of the blank being sufficient to cut here a single element such as 31 by any known technique. An initial metal strip is chosen according to the width L and maximum thickness of the trapezoid. In that blank, each of the elements 31 is then cut, preferably using cutting means dependent on the profile 32 of the tread to be molded. Cutting of the profile 32 will, of course, typically be different for each of the elements 31, according to the sculptured pattern of the tread to be molded. The invention lends itself perfectly well to computer-assisted manufacture. From the files containing the definition of the sculpture, a preform cutting tool can be controlled, such as, for example, a laser cutting tool. The invention therefore makes it possible to produce molds of the type described in U.S. Pat. No. 5,492,669 according to a very direct method.

I claim:

1. A process of machining a sheet without removal of material, comprising:

nipping said sheet between two longitudinal tool bearings engaging the sheet across a section of the latter, said bearings delimiting between them a calibration opening, whose large dimension is greater than the width of the sheet to be machined and whose small dimension determines the thickness of the sheet along said section;

grasping said sheet at one end, over the whole width of said sheet, adjacent the calibration opening;

pulling the sheet by said end so as to advance an initial section of the sheet from within the plane containing the calibration opening and thus pass the sheet through the calibration opening, while said longitudinal bearings are kept supported against said sheet, and progressively changing the spacing between the bearings as the sheet passes through the calibration opening so as to control said thickness of the sheet that has passed through the calibration opening according to a predetermined relationship as a function of the distance that the initial section has been advanced beyond the calibration opening, said predetermined relationship being such that the thickness of the sheet is caused to be continuously changed along the length between the initial section and the calibration opening.

2. A process according to claim 1, in that the relationship is such that the thickness increases linearly with the distance of separation.

3. A process according to claim 1, in that the relationship is such that the thickness diminishes when the separation increases.

4. A process according to claim 1, in that machining entails several successive passes so as to gradually achieve a desired thickness.

5. A process according to claim 1, used for the fabrication of blanks, in which said sheet comes in the form of a continuous strip, and in which at the end of the machining phase the said bearings are brought nearer to mark a zone of sectioning of said strip and then, without relaxing the support of said bearings, a blank is individualized by pulling said strip until breaking at the section zone.

6. A process of manufacture of a tire tread mold, said mold being formed by circumferential stacking of a large number of elements, the section of which, seen in a plane perpendicular to the axis of the mold, is trapezoidal, comprising fabricating blanks by applying the process according to claim 5, cutting one or more elements in each blank to the desired profile and then circumferentially stacking said elements to form said mold.

7. A device for machining a sheet comprising:

a jaw equipped with two plates mounted opposite each other in order to delimit a calibration opening between said plates;

means for varying the spacing between plates;

a clamp for grasping the sheet;

means for moving said clamp in relation to said plates for feeding the sheet through and beyond the plates;

means for coordinating the movement of said clamp and the relative position of said plates, so as to slide the sheet in relation to said plates while the distance between said plates is progressively controlled, said means for coordinating being such that the space between the two plates is caused to be continuously and progressively changed with the advance of the clamp in order that the thickness of the sheet downstream of the calibration opening is continuously changed by the progressively controlled distance between said plates.

8. A device according to claim 7, in that said plates have convergent bearings, which define a direction of advance for the sheet.

9. A device according to claim 7, including means for dispensing a lubricating fluid opposite the calibration opening.

* * * * *

UNITED STATES PATENT AND TRADEMARK OFFICE

CERTIFICATE OF CORRECTION

PATENT NO. : 6,044,680

DATED : April 4, 2000

INVENTOR(S) : Pegoraro

It is certified that error appears in the above-identified patent and that said Letters Patent is hereby corrected as shown below:

In the Specification:

Column 2, line 18: "ansehlargement" should read – an enlargement –

Signed and Sealed this

Eighth Day of May, 2001

*Attest:*

Nicholas P. Godici

NICHOLAS P. GODICI

*Attesting Officer*

*Acting Director of the United States Patent and Trademark Office*